US005269162A

United States Patent [19]

Robida et al.

[11] Patent Number: 5,269,162

[45] Date of Patent: Dec. 14, 1993

[54] CYLINDER LOCK

[75] Inventors: James E. Robida, Cobalt; Vladimir Freilich, Avon; Richard M. Davidian, Kensington, all of Conn.

[73] Assignee: Emhart Inc., Newark, Del.

[21] Appl. No.: 53,823

[22] Filed: Apr. 29, 1993

Related U.S. Application Data

[63] Continuation of Ser. No. 596,888, Oct. 12, 1990, abandoned.

[51] Int. Cl.[5] ..... E05B 17/04

[52] U.S. Cl. ..... 70/224; 70/379 R; 70/380; 70/432

[58] Field of Search ..... 70/388, 461, 379 R, 70/379 A, 380, 374, 432, 420, 423, 427, 414, DIG. 59

[56] References Cited

U.S. PATENT DOCUMENTS

| | | | |
|---|---|---|---|
| 594,631 | 11/1897 | Lockwood | 70/379 R |
| 2,018,093 | 10/1935 | Schlage | 70/432 |
| 2,213,262 | 9/1940 | Segal | 70/379 R |
| 2,400,229 | 5/1946 | Freeman | 70/379 R |
| 2,691,290 | 10/1954 | Schlage | 70/379 R |
| 2,803,959 | 8/1957 | Schlage | 70/379 R |
| 2,948,140 | 8/1960 | Etsten . | |
| 3,125,876 | 3/1964 | Kuchler . | |
| 3,128,618 | 4/1964 | De Vines . | |
| 3,210,975 | 10/1965 | Best . | |
| 3,605,463 | 9/1971 | Epstein . | |
| 4,109,496 | 8/1978 | Allemann et al. | 70/380 |
| 4,123,926 | 11/1978 | Elder | 70/375 X |
| 4,254,648 | 3/1981 | Dietrich | 70/380 |
| 4,262,507 | 4/1981 | Flack et al. | 70/432 |
| 4,312,198 | 1/1982 | Sedley | 70/276 |
| 4,369,642 | 1/1983 | Grell | 70/380 X |
| 4,580,425 | 4/1986 | Smith | 70/421 |
| 4,663,953 | 5/1987 | Fish et al. | 70/380 |
| 4,932,229 | 6/1990 | Genakis | 70/494 |
| 5,010,749 | 4/1991 | Lin | 70/379 R X |

*Primary Examiner*—Lloyd A. Gall
*Attorney, Agent, or Firm*—J. Bruce Hoofnagle

[57] ABSTRACT

A cylindrical lock assembly (20) includes an inside subassembly (22) and an outside subassembly (24) which are assembled with a door (326). Each subassembly (22,24) includes a rose liner (26,38), a return spring cassette (28,40), a rose (30,42), a lever (32,46) and a lever insert (34,48). The inside subassembly (22) also includes a turn button (36) and the outside subassembly (24) includes a cylinder lock (44).

Cylinder lock (44) includes a plug (114) within a shell (112). A rib (122) for supporting tumbler pins (428) is formed with the shell. An identifier actuator (456) is depressed by a tailpiece (116) when a turn button (36) is operated to lock the assembly (20). When the actuator (456) is depressed, an identifier pin (436) is moved within the plug (114) and extends partially from the front of the plug to signify that the assembly (20) has been locked from the inside.

3 Claims, 6 Drawing Sheets

402
408
423
414
416
418
406
114
421
410
412
425

400
404
410
406
420
420
418
114
402
411
409
124
432
430
428
426
122
424
112
426
422
434
438
436
440
44
442
444
450
446
454
452
460
456
464
468
465
466
462
476
116
468
458
474
472
118
472
478
470
120
480
482

460
464
462
456
465
458

484
486
488
120
488

CYLINDER LOCK

This is a continuation of application Ser. No. 07/596,888, filed Oct. 12, 1990, now abandoned.

CROSS-REFERENCE TO RELATED APPLICATIONS

The following applications are cross referenced herein as related applications, are filed on even date herewith, and are incorporated herein by reference thereto.

1. Title: Cylindrical Lock Assembly
Applicants: James E. Robida; Kenneth W. Strickland
U.S. Pat. No. 5,125,696; Issued Jun. 30, 1992
2. Title Cylindrical Lock Assembly
Applicants: Mohammed A. Haq; Edward T. Leitkowski, Jr.
U.S. Ser. No. 07/596,882
U.S. Pat. No. 5,141,269

3. Title: Cylindrical Lock Assembly
Applicants: James E. Robida; Edward T. Leitkowski, Jr.
U.S. Pat. No. 5,123,682; Issued Jun. 23, 1992

4. Title: Cylindrical Lock Assembly
Applicants: James E. Robida; Kenneth W. Strickland
U.S. Ser. No. 07/596,890
U.S. Pat. No. 5,145,223

BACKGROUND OF THE INVENTION

This invention relates to a cylinder lock and particularly relates to a cylinder lock having an adjustable tailpiece.

Typically, a cylindrical lock assembly includes a rollback or sleeve onto which is assembled a knob or lever which functions as a lock operator. A spring-biased plate extends partially from within the sleeve and through a slot in the sleeve and serves to retain the knob or lever with the sleeve. The knob or sleeve may be removed from the sleeve by selective depression of the plate into the sleeve through an access hole in the knob or sleeve. Since removal of the knob or lever will expose the inner portions of the assembly and thereby provide possible unauthorized entry, it is important that the knob or lever be removable only by an authorized person.

The cylindrical lock assembly has a cylinder lock which includes a tailpiece which is rotatable upon operation of the lock by use of a key. The tailpiece typically functions upon key operation of the lock to retract a latch bolt to permit opening of a door to which the assembly is mounted. In addition, the tailpiece is positioned within the sleeve adjacent the spring-biased plate and prevents inward movement of the plate when the cylinder lock is in the locked condition. When the key is used to unlock the cylinder lock, the tailpiece is thereby rotated to a position which permits the depression of the spring-biased plate by use of an implement positioned through the access hole of the knob or lever.

Thus, the requirement that a key must be used in the cylinder lock to facilitate removal of the knob or lever is a significant security feature of such a system.

Due to the fixed location of the spring-biased plate within the sleeve and the slot through which it extends, the tailpiece must be in a precise orientation and location to prevent manipulation of the plate regardless of whether the cylinder lock is assembled with a knob or a lever.

Typically, in a lever arrangement, the key slot and a rib portion of the cylinder lock are oriented horizontally in which case the tailpiece is also oriented horizontally and is in proper orientation to prevent movement of the spring-biased plate. When the key is operated, the tailpiece is rotated to permit depression of the spring-biased plate and removal of the lever from the sleeve if desired.

In a knob arrangement, the key slot and rib portion are oriented in a vertical direction. However, the tailpiece must be in the horizontal orientation to preclude movement of the spring-biased plate.

Therefore, when it is desired to change from a lever-operated system to a knob-operated system, a cylinder lock of dedicated design must be provided for each system. This requires dual manufacturing, packaging and stocking. Also, it is an added cost to the ultimate customer who is changing from a lever to a knob system.

Thus, there is a need for versatile cylinder lock which can be used in both the knob-operated and the lever-operated systems.

SUMMARY OF THE INVENTION

In view of the foregoing problem, it is an object of this invention to provide a cylinder lock which has versatility in use with knob-operated systems and lever-operated systems.

Another object of this invention is to provide a cylinder lock which forms a component of a cylinder lock which forms a component of a cylindrical lock assembly with versatility in use with a knob-operated or lever-operated system.

With these and other objects in mind, this invention contemplates a cylinder lock which includes a shell having an axial opening for supporting a plug therein. A rib extends radially from the shell along the length thereof. The rib and plug are each formed with a plurality of aligned transaxis holes which receive tumbler pins within the holes which are retained therein. A key slot is formed in a first or entry end of the plug in the axial direction and extends through a second end thereof. A tailpiece is attachable to the second end of the plug. Adjusting means are provided for adjustably attaching the tailpiece to the second end of the plug so that the tailpiece can be adjustably positioned in at least two orientations relative to the orientation of the key slot.

Other objects, features and advantages of the present invention will become more fully apparent from the following detailed description of the preferred embodiment, the appended claims and the accompanying drawings

DETAILED DESCRIPTION OF THE PREFERRED EMBODIMENTS

Figure 1:
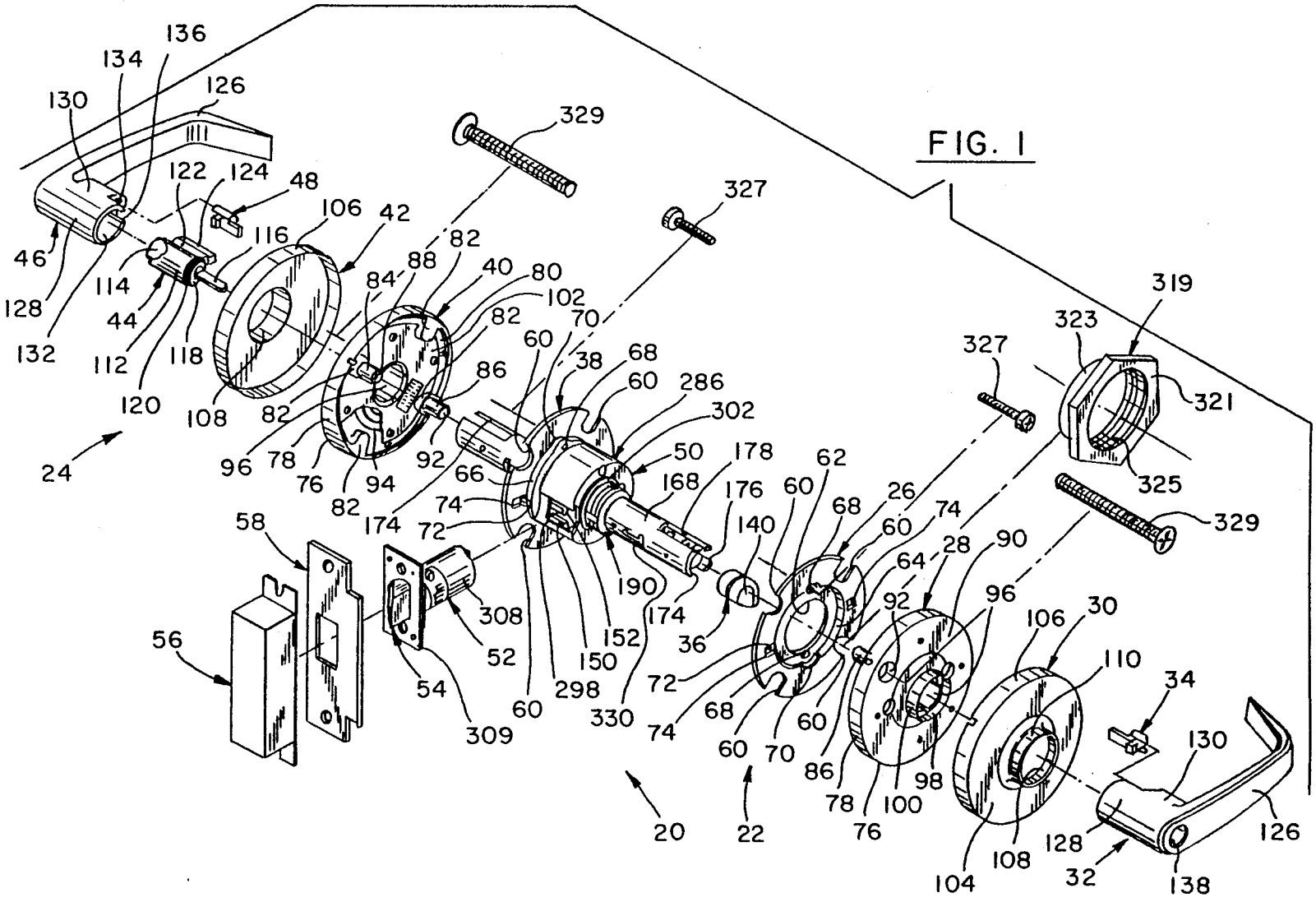
FIG. 1 is an exploded perspective view of a cylindrical lock assembly embodying certain principles of the invention.

As illustrated in FIG. 1, a cylindrical lock assembly 20 includes an inside subassembly 22 and an outside subassembly 24. The inside subassembly 22 includes a rose liner 26, a return spring cassette 28, a rose 30, a lever 32, a lever insert 34 and a turn button 36. The outside assembly 24 includes a rose liner 38, a return spring cassette 40, a rose 42, a cylinder lock 44, a lever 46 and a lever insert 48.

A chassis 50 is located between the inside subassembly 22, and the outside subassembly 24. A latch assembly 52 is positioned for operable attachment to chassis 38 and includes a latchbolt 54 which extends outwardly from the latch assembly in an extended or latched position in a direction away from the chassis 50. A strike box 56 and a strike 58 are mounted in a door frame (not shown) in cooperation with the cylindrical lock assembly 20.

Rose liners 26 and 38 are each formed in a circular configuration with four equally spaced slots 60 in the periphery thereof. Each of the liners 26 and 38 are formed with an axial opening 62, as illustrated with respect to liner 26, around which is formed a circular depression 64 on one side thereof and which appears as a protruding section 66 on the opposite side thereof as illustrated with respect to rose liner 38. A pair of screw holes 68 are formed in the depression 64 and through the protruding section 66 with clearance walls 70 formed therearound. A pair of tabs 72 are formed by punching holes 74 through the rose liners 26 and 38 with the tabs extending toward the other rose liners.

Cassettes 28 and 40 each include a circular housing 76 formed with a side wall 78 to form a dish-like cavity 80. Four equally spaced pads 82 are formed in the cavity and extend radially inwardly from side wall 78. The pads 82 are formed with an exterior configuration which is consistent with the shapes of slots 60 of rose liners 26 and 38. A pair of posts 84 and 86 are formed on two oppositely spaced pads 82 and extend outwardly from cavity 80. Post 84 is formed with an axial hole 88 which is threaded and extends through the post but does not extend through an outer face 90 which is illustrated on cassette 28. Post 86 is formed with an unthreaded hole 92 which extends through outer face 90.

A coil or torsion spring 94 and a lever arbor 96 are positioned in a concentric axial arrangement within cavity 80 so that the arbor extends into and partially through an axial opening 98 formed through outer face 90 and a hub 100 which extends outwardly from the outer face. Also, arbor 96 is mounted for rotary movement relative to housing 76. An outer end of spring 94 is attached to an adjacent portion of cavity 80 to preclude movement of the outer end. An inner end of spring 94 is attached to arbor 96 for movement with the arbor thereby allowing compression of the coil spring. A cover 102 is positioned within cavity 80 and over coil spring 94 and arbor 96 and is fastened to housing 76 to retain the spring and arbor in the concentric and axial arrangement within the cavity.

Roses 30 and 42 are each formed with a circular face 104 and a side wall 106. An axial opening 108 is formed through the face 104 and extends through a hub 110 which extends outwardly from the face.

Cylinder lock 44 includes a cylinder shell 112 with a central axial opening for receiving a cylinder plug 114. A tailpiece 116 extends axially from one end of plug 114 and though a tailpiece anchor plate 118 which is held with shell 112 by a threaded cap 120. A tumbler supporting rib 122 is formed integrally with shell 112 and extends laterally therefrom. A tumbler cover 124 is positioned over the outer portion of rib 122 to contain pin tumblers which are contained within the rib in alignment with mating portions of plug 114 to provide a key-operated locking facility.

Levers 32 and 46 each include a handle 126 which is formed integrally with a hub 128. A protrusion 130 is formed integrally with handle 126 and hub 128 at the inner corner of the juncture of the handle and hub. Hub 128 is formed with an axial opening 132 which communicates with an opening 134 formed in protrusion 130. Further, a slot 136 is formed in hub 128 which communicates with the outward end portion of axial opening 132 formed in the hub. An opening 138 is formed through handle 126 in axial alignment with, and in communication with, axial opening 132. Opening 138 is of a smaller diameter than the diameter of opening 132.

Turn button 36 is formed with a finger-grip end 140 at one end thereof which normally protrudes from opening 138 of lever 32. An attachment structure is formed at the opposite end of turn button 36 for engagement with elements within chassis 50 to facilitate locking of the latchbolt 54 in the extended position or latched by rotation of the button.

Figure 3:
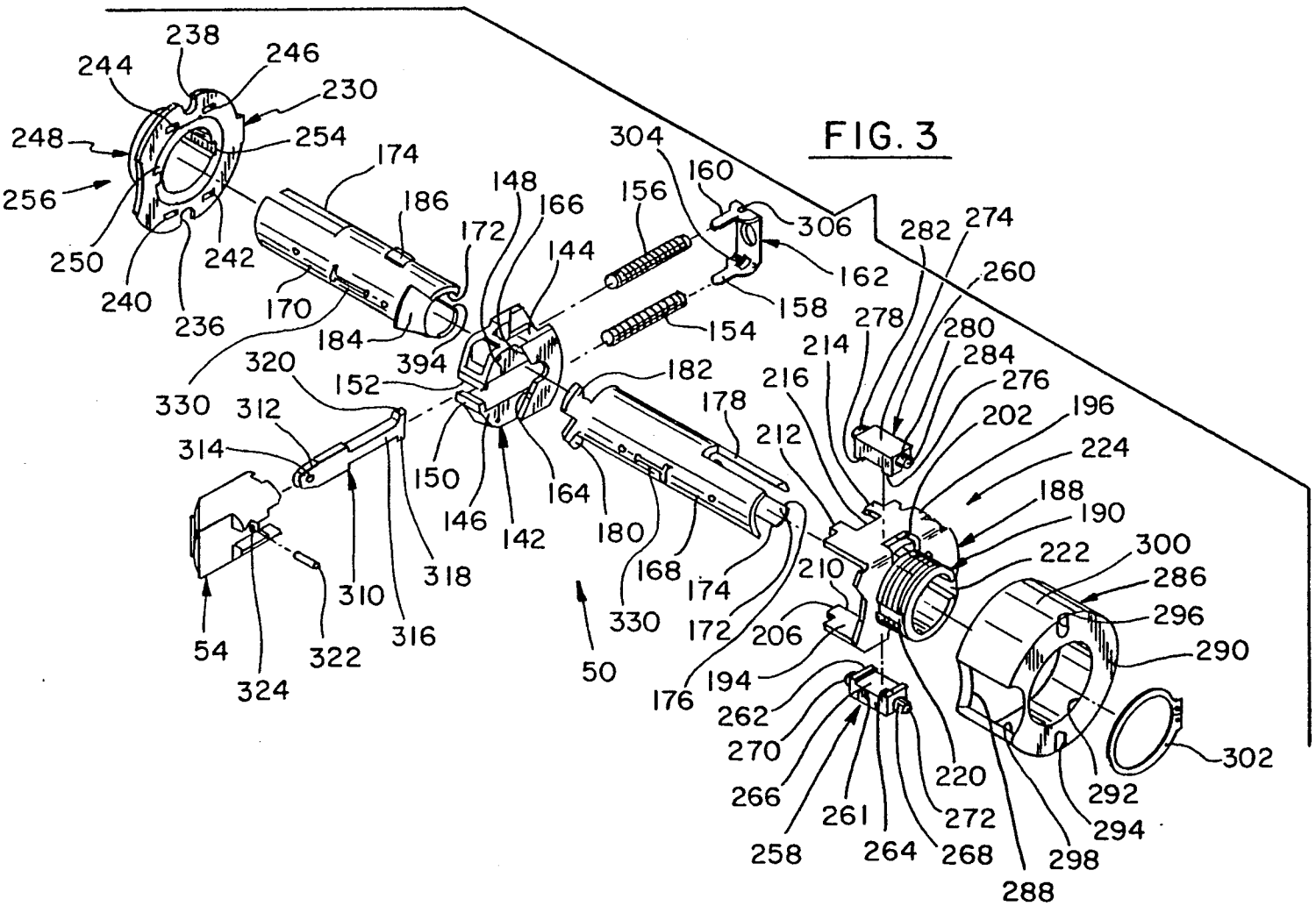
FIG. 3 is an exploded perspective view of a chassis of the cylindrical lock assembly of FIG. 1.

Referring now to FIGS. 1 and 3, chassis 50 includes a retractor 142 which is formed with a rear support 144 and a pair of vertically spaced, horizontally extending arms 146 and 148. The facing ends of arms 146 and 148 are formed with lips 150 and 152, respectively. A pair of pockets (not shown) are formed in the rear of support 144 to receive one end of a pair of compression springs 154 and 156. The opposite ends of springs 154 and 156 are positioned over a pair of spaced fingers 158 and 160, respectively, of an integrally formed retainer 162. Retractor 142 is formed with a pair of cam surfaces 164 and 166 on one side thereof. A similar pair of cam surfaces (not shown) are formed on the opposite side of retractor 142.

A pair of rollbacks or sleeves 168 and 170 are each formed with an axial through hole 172 and with slots 174, 176, and 178 in one end thereof. Slots 174 and 178 are aligned-vertically and slot 176 is located on one side of the sleeves 168 and 170 angularly spaced by ninety degrees from slots 174 and 178. Sleeve 168 is formed with a pair of camming elements 180 and 182 which are formed by rolling back portions of the sleeve which extend from the end of the cylindrical portion of the sleeve. A single camming element 184 is formed from sleeve 170. A tab 186 protrudes outwardly from an intermediate portion of each of the sleeves 168 and 170. As illustrated in FIG. 3, tab 186 protrudes from an upper surface of sleeve 170. Tab 186 of sleeve 168 extends from a lower surface of the sleeve but is not visible in FIG. 3.

Figure 4:
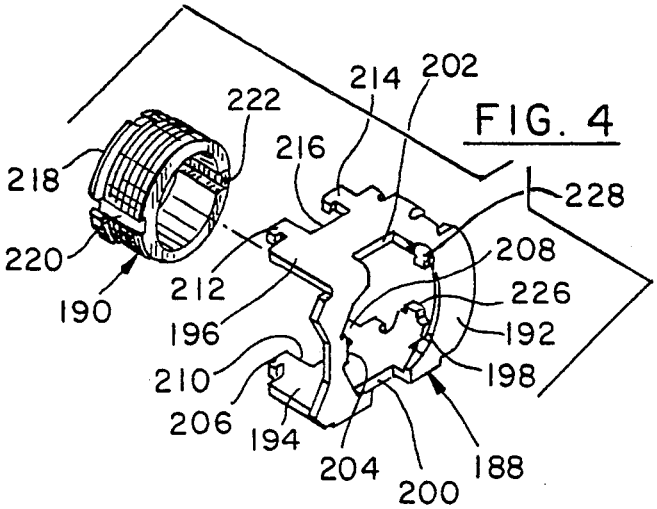
FIGS. 4 and 5 are exploded perspective views of components of the chassis of FIG. 3.

Referring to FIGS. 3 and 4, chassis 50 further includes a case 188 and a sleeve 190. Case 188 is formed in a U-shaped configuration having a base 192 and a pair of legs 194 and 196 formed integrally with the base. Base 192 is formed with an opening 198 which communicates with a pair of notches 200 and 202 formed in the legs 194 and 196, respectively, at the junctures of the legs and the base. Base 192 is further formed with a tab 204 which protrudes slightly into opening 198. Leg 194 is formed with a pair of spaced, hook-like tabs 206 and 208 at the free end of the leg with a notch 210 formed in the free end of the leg between the tabs. In similar fashion, leg 196 is formed with a pair of spaced, hook-like tabs 212 and 214 at the free end of the leg with a notch 216 formed in the free end of the leg between the tabs.

Sleeve 190 is formed in a cylindrical shape with a flange 218 at one end thereof which has a diameter greater that the diameter of the opening 198 of case 188. The periphery of sleeve 190 is threaded and is formed with a longitudinal slot 220 therein. Further, a longitudinal slot 222 is formed in the inner wall of sleeve 190.

As illustrated in FIG. 3, the threaded portion of the sleeve 190 is inserted between legs 194 and 196 and through opening 198 of case 188 with flange 218 resting against the inner surface of base 192 adjacent the opening. In this arrangement, the threaded portion of the sleeve 190 extends from the outer surface of base 192 and combines with case 188 to form a case assembly 224.

Referring again to FIG. 4, an inwardly turned tab 226 is formed along a side edge of leg 194 of case 188. In similar fashion, an inwardly turned tab 228 is formed along a side edge of leg 196 of case 188 in spaced and aligned relation with tab 226.

Figure 5:
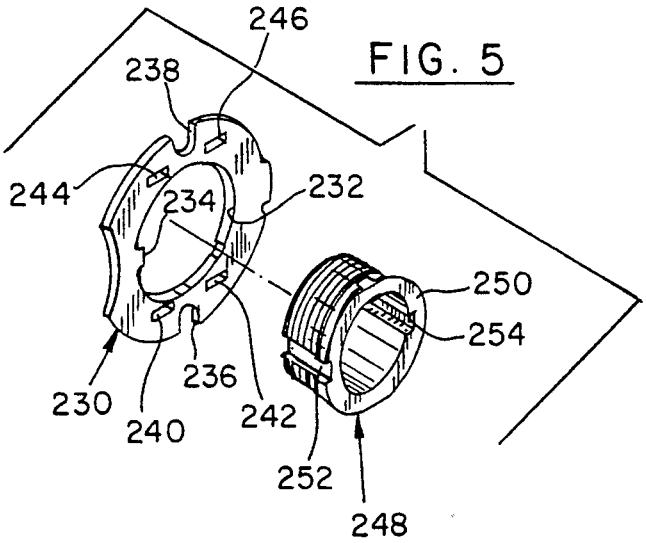

Referring to FIGS. 3 and 5, a cap 230 in generally circular and is formed with a central opening 232 and a tab 234 protruding inwardly into the opening. A pair of diametrically opposed slots 236 and 238 are formed in the periphery of cap 230. Four spaced through holes 240, 242, 244 and 246 are formed in cap 230. A sleeve 248 is of cylindrical shape and is formed with a flange 250 at one end thereof which has a diameter larger than the diameter of opening 232. The peripheral surface of sleeve 248 is threaded and is formed with a longitudinal slot 252. A longitudinal slot 254 is formed in the inner wall of sleeve 248. As illustrated in FIG. 3, cap 230 and sleeve 248 are assembled to form a cap assembly 256 with the threaded portion of the sleeve inserted through opening 232 and extending outwardly from the cap. In this position, flange 250 is flush against the adjacent surface of cap 230.

As illustrated in FIG. 3, chassis 50 further includes a pair of spaced mounting blocks 258 and 260. Block 258 is formed with a central body 261 and a pair of spaced pedestals 262 and 264 which extend outwardly from opposite ends of a surface 266 of the body. A pair of posts 268 and 270 extend from opposite ends of body 261 of block 258 with a threaded hole 272 extending longitudinally through the body and the posts. Block 260 is formed in identical fashion with a body 274 and spaced pedestals 276 and 278 extending from one surface of the body. A pair of posts 280 and 282 extend from opposite ends of the body 274 and a threaded hole 284 extends longitudinally through the body and the posts.

Referring again to FIG. 3, chassis 50 includes a housing 286 which is generally of cylindrical shape. One side 288 of housing 286 is completely open while the other side 290 is formed with a smaller opening 292. Also, side 290 is formed with spaced holes 294 and 296. An opening 298 is formed in the peripheral surface 300 of housing 286. Chassis 50 further includes a retaining ring 302.

In assembly of the components of chassis 50, sleeves 168 and 170 are positioned so that camming elements 180 and 182 are located between cam surfaces 164 and 166 and camming element 184 is located adjacent to an associated cam surface on retractor 142. The forward ends of springs 154 and 156 are positioned in mating pockets of retractor 142 and the rear ends of the springs are positioned over fingers 158 and 160. This forms a retractor subassembly.

The retractor subassembly is then located so that sleeve 168 is positioned through and extends outwardly from the axial opening of sleeve 190. In this position, retractor 142 is located in the space between legs 194 and 196 and close to the inner surface of base 192. Retainer 162 is formed with a pair of spaced slots 304 and 306 which rest over tabs 226 and 228 of case 188 thereby placing springs 154 and 156 in a contained position for subsequent compression.

Cap assembly 256 is then positioned over sleeve 170 with tabs 206, 208, 212 and 214 of case 188 being located in and through holes 240, 242, 244, 246, respectively.

In this fashion, retractor 142 the inward ends of sleeves 168 and 170, spring 154 and 156 and retainer 162 are contained within the enclosure formed by the securance of cap assembly 256 with case 188.

Pedestals 262 and 264 of block 258 are positioned in notches 200 and 210, respectively of case 188 and pedestals 276 and 278 of block 260 are positioned in notches 202 and 216, respectively, of the case. Housing 286 is then manipulated so that sleeve 168 extends outwardly from opening 292 of the housing and sleeve 170 extends outwardly from open side 288 of the housing. In this arrangement, the secured cap assembly 256 and case 188, and the elements contained therein as noted above, are located within housing 286 with lips 150 and 152 of retractor 142 exposed through opening 298 of the housing.

Retaining ring 302 is positioned about the threaded portion of sleeve 190 and against side 290 of housing 286 to retain the elements of chassis 50 in the assembly as described above.

It is noted that in the assembled chassis 50, the threaded holes 272 and 284 of blocks 258 and 260, receptively, are aligned with slots 236 and 238, respectively, of cap assembly 256 and holes 294 and 296, respectively, of housing 286. Also, as illustrated in FIG. 1, rose liner 38 is positioned over sleeve 170 and the threaded portion of sleeve 248 of cap assembly 256 and located adjacent the open side 288 of housing 286. In this position, screw holes 68 of rose liner 38 are aligned with the threaded holes 272 and 284 of blocks 258 and 260, respectively. Screws can then be placed through screw holes 68 of rose liner 38 and threadedly secured within one end of holes 272 and 284 of blocks 258 and 260, respectively, to secure the rose liner with the chassis 50.

Referring now to FIGS. 1 and 3, latch assembly 52 includes a latch case 308 which is secured at one end thereof to a front plate 309. Latchbolt 54 is contained partially within case 308 and extends outwardly therefrom to the extended position and through an opening in front plate 309. It is noted that latchbolt 54 is retractible into case 308 to a retracted or unlatched position. Therefore, latchbolt 54 is movable between the extended or latched position and the retracted or unlatched position. As viewed in FIG. 3, a tail piece or link 310 is formed with a head 312 and lateral through hole 314 at one end thereof. Link 310 is formed with a T-shaped tail 316 at the other end thereof and includes cross arms 318 and 320. Head 312 is located within a slot (not shown) formed in rear of latchbolt 54 and is pivotally secured thereto by a pin 322 which is inserted through aligned holes, including a hole 324, formed in the latchbolt and hole 314 formed in the head.

Head 312 and the portion of latchbolt 54 to which the head is attached are contained within case 308. Tail 316 extends from the rear of case 308 and is designed to be positioned eventually through opening 298 of housing 286 with cross arms 318 and 320 being located behind lips 150 and 152 of retractor 142. In this fashion, upon rotation of sleeves 168 or 170, camming elements 180 and 182 will engage cam surfaces 164 and 166 to urge retractor 142 rearwardly against the biasing of springs 154 and 156. As retractor 142 is moved rearwardly, link 310 is pulled with the retractor to withdraw latchbolt to the retracted position.

Figure 2:
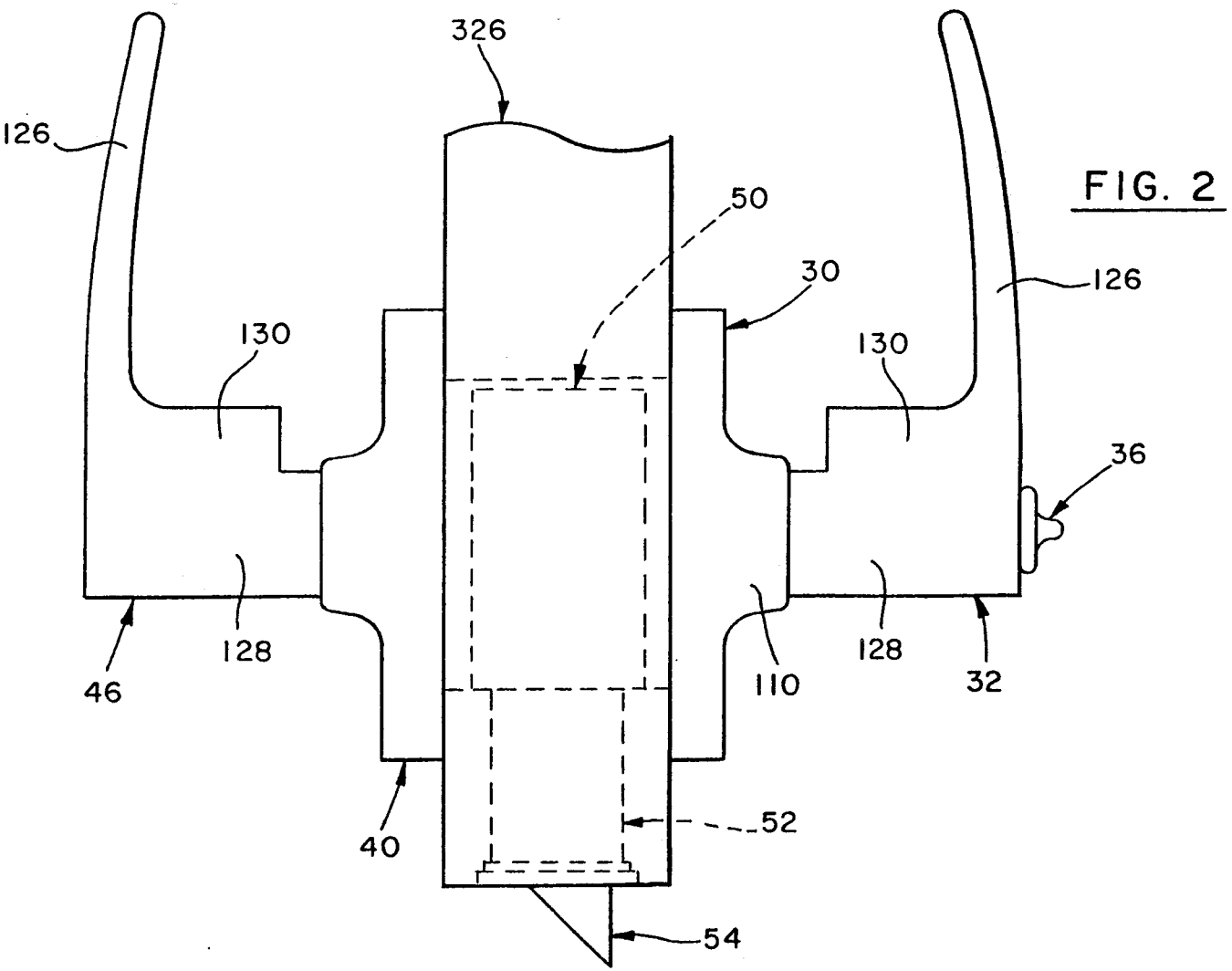
FIG. 2 is a plan view of the cylindrical lock assembly of FIG. 1 as assembled with a door.

In further assembly of the components of cylindrical lock assembly 20 of FIG. 1, case 308 of latch assembly 52 is positioned within an opening (not shown) in the edge of a door 326 (FIG. 2) which communicates with a larger door opening which later receives chassis 50. Chassis 50 with attached rose liner 38 is then inserted through the larger door opening in door 326 where the door opening is slightly larger in diameter than the diameter of housing 286. As chassis 50 is moved into the larger opening, the chassis engages and becomes attached to the tail-end of latch case 308. Also, tabs 72 of rose liner 38 are moved into notches in the door and the rose liner is flush with the adjacent surface of the door. In this position, housing 286 is located within the door opening and sleeves 168 and 170 extend from opposite sides of the door. Tail 316 of link 310 is then attached to retractor 142 in the manner previously described and plate 309 is secured to the edge of door 326 in a conventional manner. Rose liner 26 is then moved over sleeve 168 and toward door 326 whereby tabs 72 are moved into notches formed in the adjacent surface of the door and screw holes 68 are aligned with the other ends of threaded holes 272 and 284 of blocks 258 and 260, respectively. Thereafter, a hex nut 319 having a hex flange 321 and a sleeve section 323 with a threaded axial hole 325 is threadedly mounted onto sleeve 190 until the hex flange seats in the depression 64 of rose liner 26. Screws, such as screws 327, are then positioned through holes 68 of rose liner 26 and threadedly into holes 272 and 284 to secure the rose liner in the assembled position. In this position, the head of screw 327 is located adjacent the periphery of an adjacent flat of hex flange 321 so that the screw head prevents the hex nut 319 from loosening.

It is noted that in assembling rose liners 26 and 38 in the manner described above, slots 60 of rose liner 26 are aligned with corresponding slots 60 of rose liner 38.

Cassettes 28 and 40 are then positioned over sleeves 168 and 170 so that tabs 186 are positioned within longitudinal slots formed in the cylindrical opening of arbors 96 of the cassettes. In this manner, arbors 96 are keyed to sleeves 168 and 170 to rotate upon rotation of the sleeves. As cassettes 28 and 40 are moved over sleeves 168 and 170, pads 82 of the cassettes are located in respective slots 60 of rose liners 26 and 38, respectively. As cassettes 28 and 40 are assembled in this fashion, posts 84 and 86 of each of the cassettes, are located with corresponding openings (not shown) in door 326. In this arrangement, post 84 of cassette 40 is axially aligned with post 86 of cassette 28 and post 86 of cassette 40 is axially aligned with post 84 of cassette 28. The threaded end of a screw 329 is placed through unthreaded hole 92 of post 86 from the outer face 90 of cassette 28 and into threaded hole 88 of post 84 of cassette 40. In similar fashion, the threaded end of another screw 329 is placed through unthreaded hole 92 of post 86 from the outer face of cassette 40 and into threaded hole 88 of post 86 of cassette 28. The screws 329 are then tightened to draw cassettes 28 and 40 to a secure position on opposite sides of door 326 whereby the heads of the screws come to rest in countersunk holes in the outer faces 90 of the cassettes in alignment with post holes 86.

Roses 30 and 42 are then positioned over cassettes 28 and 40, respectively, and are held in assembly by a dimple and detent arrangement (not shown) formed in complimentary fashion in the roses and cassettes. Other arrangements could be used to secure roses 30 and 42 with cassettes 28 and 40, respectively, such as, for example, a dimple and L-shaped slot arrangement (not shown). One end of turn button 36 is then positioned within sleeve 168 to mate with conventional locking facilities within chassis 50 to permit selective locking of latchbolt 54 in the extended position upon turning of the turn button. Insert 34 is positioned within an inward opening of protrusion 130 of lever 32. Thereafter, opening 138 of lever 32 is positioned onto and over sleeve 168 so that finger-grip end 140 of turn button 36 extends through the outward end of opening 138.

It is noted that turn button 36 is spring-biased outwardly from sleeve 168 but is formed with a flange which precludes movement of the button axially outwardly from opening 138 other than the extended finger-grip end 140. It is further noted that a pair of spaced longitudinal ribs are formed radially inwardly within opening 132 of lever 32 which fit into slots 174 and 178 of sleeve 168 to facilitate rotation of the sleeve upon actuation of the lever. Since arbor 96 is keyed to sleeve 168 by tab 186 on the underside of the sleeve, spring 94 will be compressed upon actuation of lever 32, by an operator. Compressed spring 94 will provide the force to return lever 32 to its home position upon release thereof by the operator. Opening 132 of lever 32 is formed with a transverse slot or depression in hub 128 and is positioned for alignment with a slot 330 formed in sleeve 168. A spring-biased detent or catch plate extends through slot 330 and into the depression of opening 132 to retain lever 32 with sleeve 168. A small hole extends from the outer surface of hub 128 and communicates with the depression in opening 132 to facilitate insertion of an implement to retract the spring-biased detent and permit extraction of lever 32 from the assembly.

Cylinder lock 44 is positioned within the axial opening 132 of hub 128 of lever 46 whereby the rib 122 and cover 124 are moved through and beyond lever slot 136 and into opening 134 of protrusion 130. Insert 48 is then assembled with lever 46 so that a portion of the insert covers slot 136 and another portion covers opening 134. This provides an exterior cover for slot 136 and opening 134 which blends structurally with and follows the contours of adjacent exterior portions of hub 128 and protrusion 130.

Lever 46, with cylinder lock 44 and insert 48 assembled therewith, is then manipulated to position axial opening 132 over sleeve 170. Ribs which are formed within opening 132 are moved into slot 174 of the sleeve and a slot of the sleeve which is diametrically opposite slot 174. Further, rib 122 and cover 124 of lock assembly 44 are moved into a slot on the far side of sleeve 170 equally spaced from slot 174 and the diametrically opposite slot. Eventually, a portion of the spring-biased detent or catch plate extends through slot 330 (FIG. 3) and sleeve 170 moves into a transverse slot or depression in hub 128 of lever 46 to retain the lever with sleeve 170 to complete assembly of cylindrical lock assembly 20. It is noted that sleeve 170 is formed with the same three-slot arrangement as sleeve 168 which is formed with slots 174, 176 and 178. Sleeves 168 and 170 are thereby interchangeable by merely rotating the sleeves vertically through one hundred and eighty degrees whereby slot 174 is on the bottom for the postion of sleeve 168 and is on the top for the position of sleeve 170.

Figures 6, 7:
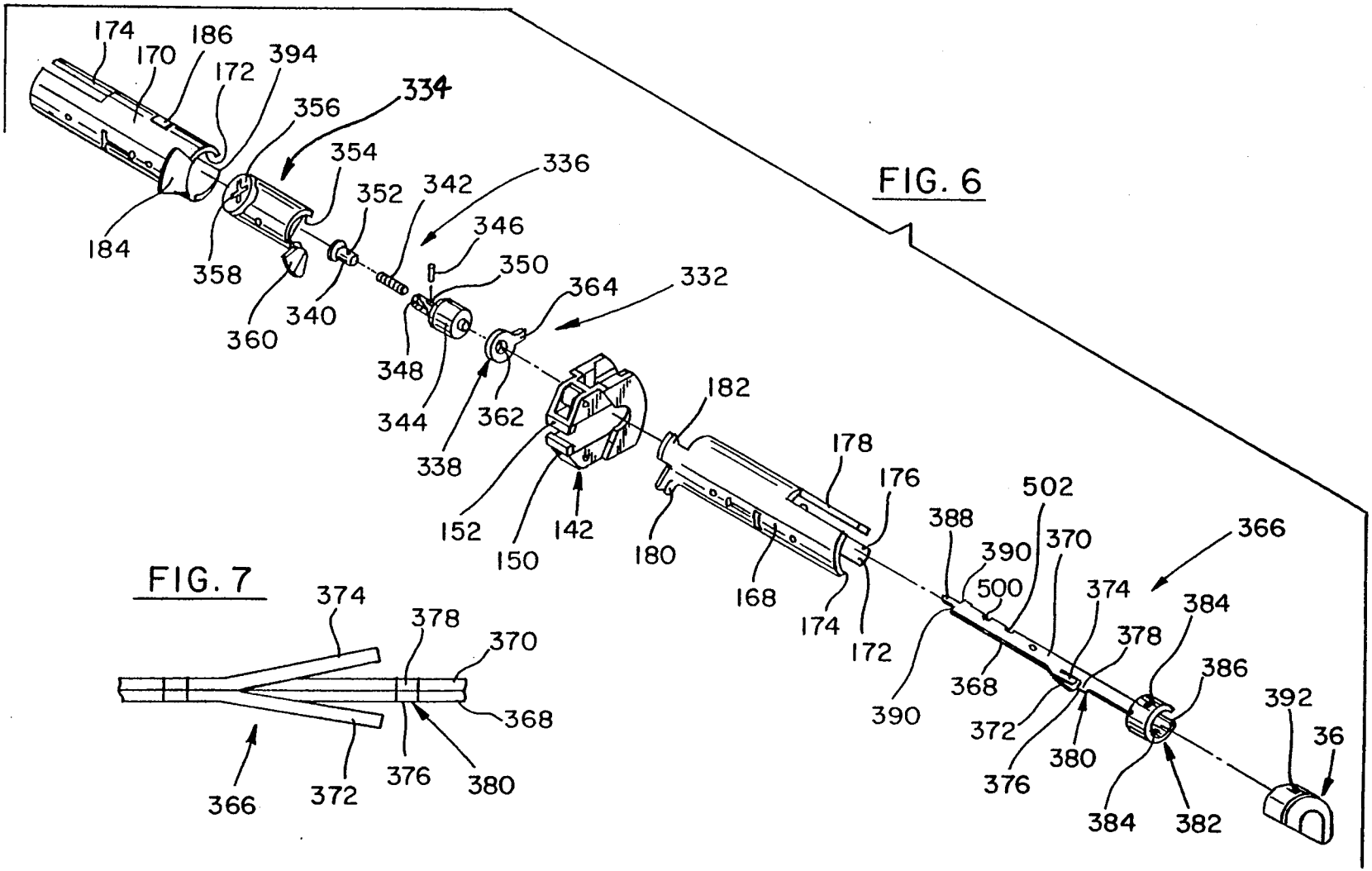
FIG. 6 is an exploded perspective view of a locking arrangement which can be used with the cylindrical lock assembly of FIG. 1.
FIG. 7 is a partial plan view of a linkage bar of the locking arrangement of FIG. 6.

Referring to FIG. 6, a lock mechanism 332 is illustrated with a portion of the elements of FIG. 1 to show an embodiment of a lock mechanism which functions with cylindrical lock assembly 20. It is to be understood that other lock mechanisms could be used without departing from the spirit and scope of applicants, invention.

As illustrated, sleeves 168 and 170 are located on opposite sides of retractor 142 of chassis 50. Interposed between sleeve 170 and retractor 142 are an auxiliary sleeve or rollback 334, a plunger assembly 336 and a locking dog 338. Plunger assembly 336 includes a plunger head 340, a spring 342, a plunger body 344 and a pin 346. Spring 342 and head 340 are inserted into an opening 348 formed axially in one end of body 344. Pin 346 is then inserted through an elongated slot 350 and into a hole 352 formed in head 340. Spring 342 normally urges head 340 outwardly from opening 348 but is prevented from moving out of the opening by virtue of the assembly of pin 346. Also, since pin 346 is located within elongated slot 350, head 340 is permitted to travel axially with respect to opening 348 within the defined limits of the length of the slot.

Auxiliary sleeve 334 is formed with an axial opening 354 at one end thereof and a cover 356 at the other end thereof which is formed with a centrally located cross slot 358 located for reception of tailpiece 116 of cylinder lock 44. A camming element 360 is formed at the open end of auxiliary sleeve 334. Locking dog 338 is formed with an axial hole 362 and an ear 364 which extends radially from the hole. The free end of ear 364 is always contained within slot 254 of sleeve 248 (FIG. 3) to prevent rotation of dog 338 but to permit axial movement thereof.

A linkage bar 366 is positioned on the outboard side of sleeve 168 in axial alignment therewith as viewed in FIG. 6. Linkage bar 366 is formed by riveting together two flat strips 368 and 370 (FIG. 7) of metal. Strips 368 and 370 are formed with spring-biased fingers 372 and 374, respectively, along an intermediate edge, which flare away from the assembled strips as shown in FIG. 7. Strips 368 and 370 are also formed with tabs 376 and 378, respectively, which combine in assembly to form tab 380 of linkage bar 366. A cup-shaped cap 382 is attached to the outboard end of linkage bar 366 and is formed with a pair of oppositely spaced holes 384 and a slot 386. The opposite end 388 is reduced in width to form shoulders 390.

Turn button 36 is formed with a pair of oppositely spaced inwardly projecting tabs 392. Turn button 36 is positioned over cap 382 so that tabs 392 are placed into holes 384 to retain the button with the cap and with linkage bar 366.

In assembly, linkage bar 366 with turn button 36 are moved axially so that end 388 is first moved through sleeve 168, retractor 142 and opening 362 of dog 338. Opening 362 of dog 338 is designed to permit entry of end 388 and to permit the end and bar 366 to be rotated independently of the dog when turn button 36 is rotated and to permit shoulder 390 to move the dog axially. Plunger assembly 336 is inserted into opening 354 of auxiliary sleeve 334 which, in turn is positioned within opening 172 of sleeve 170. In this position, camming element 360 of auxiliary sleeve 334 is located adjacent to camming element 184 of sleeve 170.

Linkage bar 366 is moved further inwardly to move dog 338 further within sleeve 248 (FIG. 3) to a position in the vicinity of opening 172 of sleeve 170 adjacent camming element 184. In this position ear 364 of dog 338 is located for selective positioning into a slot 394 formed in sleeve 170. Plunger body 344 is pressing against end 388 of linkage bar 366 and dog 338 to provide spring biasing of the linkage bar and turn button 36 by virtue of spring 342.

As linkage bar 366 is moved through sleeve 168, fingers 372 and 374 move through a passage internally of the sleeve where they are pressed generally together and then spring back to the position shown in FIG. 7. This permits the free ends of fingers 372 and 374 to be positioned to engage shoulders within sleeve 168 to preclude complete retraction of linkage bar 366 from within the sleeve but to permit limited axial movement therein.

When linkage bar 366 is in the unlocked position, the bar is prevented from being rotated by a first tab blocking structure within sleeve 168 which prevents tab 380 from moving in an arcing direction. In this position, spring 342 is biasing dog 338 so that ear 364 is outside of slot 394 of sleeve 170 whereby the sleeve can be rotated by operation of lever 46. This results in movement of latchbolt 54 from the latched position to the unlatched position.

When it is desired to lock assembly 20 by use of turn button 36, the button is pushed axially inward whereby tab 380 clears the first tab blocking structure within sleeve 168. Turn button 36 can now be rotated to move tab 380 through an arc to a position on the inboard side of a second tab blocking structure within sleeve 168. When turn button 36 is released, tab 380 engages the second tab blocking structure and is pressed against the structure by spring 342 to retain linkage bar 366 and the turn button in this position.

As linkage bar 366 is moved inwardly and rotated as described above, shoulders 390 move dog 338 further through sleeve 248 (FIG. 3) to a position where ear 364 is located in slot 394 of sleeve 170. This prevents sleeve 170 from being turned whereby assembly 20 is the locked condition with respect to operation of the assembly by use of outside lever 46.

As previously described, cylinder lock 44 includes a tailpiece 116 (FIG. 1) which extends toward the inboard side of assembly 20. In assembling the components of assembly 20, tailpiece 116 is inserted into slot 358. When cylinder lock 44 is in the locked condition, tailpiece 116 is prevented from turning and assembly 20 is thereby locked from the outside. In this condition, latchbolt 54 cannot be moved from the latched position by operation of outside lever 46. When a key is inserted into cylinder lock 44 and lock tumbler pins are thereby appropriately aligned, the key can be turned which results in turning of tailpiece 116. This turns auxiliary sleeve 334 whereby camming element 360 is moved to move retractor 142 and thereby retract latchbolt 54.

Figures 8, 9, 10, 11:
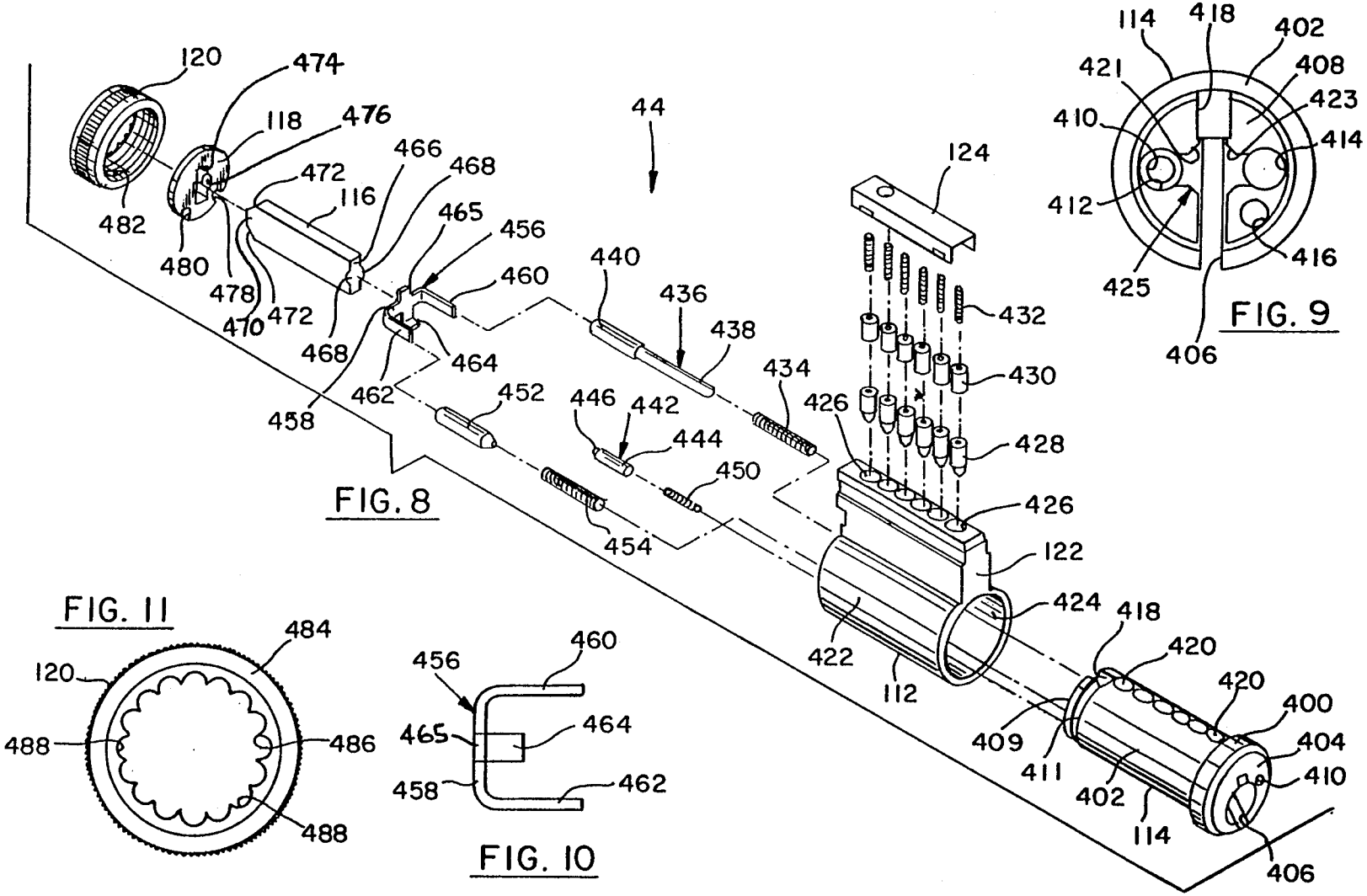
FIG. 8 is an exploded perspective view of a cylindrical lock embodying certain principles of the invention.
FIG. 9 is a rear view of a plug of the cylinder lock of FIG. 8.
FIG. 10 is a plan view of an actuator of the cylinder lock of FIG. 8.
FIG. 11 is a rear view of a cap of the cylinder lock of FIG. 8.

Referring to FIG. 8, cylinder lock 44 includes cylinder shell 112, cylinder plug 114, tailpiece 116, tailpiece anchor plate 118 and threaded cap 120. Shell 112 is formed with tumbler supporting rib 122 and cover 124.

Plug 114 is formed with flange 400 at the forward end of a body 402 of the plug and with a front face 404. A key slot 406 is formed in front face 404 and extends through plug 114 in an axial direction and exits at a rear face 408 (FIG. 9) thereof. A hole 410 is formed through body 402 in an axial direction and is formed with a counterbored portion 412. Another hole 414 is formed in rear face 408 and extends in an axial direction into body 402 but does not extend through to front face 404. Similarly, hole 416 is formed in rear face 408 and into body 402 in an axial direction but does not extend to front face 404. Further, a slot 418 is formed in rear face 408 and extends radially upwardly. Also, in the embodiment illustrated in FIG. 8, plug 114 includes six tumbler-pin holes 420, formed radially in body 402, all of which communicate with key slot 406. Also, slots 421 and 423 are formed in rear face 408 between key slot 406 and holes 410 and 414, respectively. With the formation of holes 410 and 414 being recessed in rear face 408, the alignment of slots 421 and 423 with the holes provides a cross slot 425 which is in the horizontal orientation as viewed in FIG. 9. A rearward extension 409 of body 402 is threaded and is reduced in diameter relative to the body to form a shoulder 411 therewith.

Shell 112 is formed with a cylindrical body 422 having an axial opening 424. Rib 122 is formed with six radially arranged tumbler-pin holes 426 which communicate with opening 424. Six tumbler pins 428, six pusher pins 430 and six compression springs 432 are arranged to be inserted into respective ones of holes 426. Cover 124 is then assembled to retain pins 428 and 430 and springs 432 in the assembled arrangement.

An actuator spring 434 is aligned for insertion into the counterbored portion 412 of hole 410. An identifier pin 436 is formed with a forward shank 438 and a rearward shank 440 of a diameter larger than the diameter of the forward shank. Pin 436 is insertible into hole 410 with shank 438 being located in the forward portion of the hole and shank 440 being located in the counterbored portion 412 of the hole.

A stop pin 442 is formed with a major portion 444 of a first diameter and a rearward projection 446 of a diameter smaller than the first diameter. A stop spring 450 is axially aligned with pin 442 and both are positioned for insertion into hole 416 formed in the rear face 408 of plug 114. A stabilizing pin 452 and an axially aligned actuator spring 454 are aligned for insertion into hole 414 in the rear face 408 of plug 114.

As viewed in FIGS. 8 and 10, an identifier actuator 456 is formed with a cross-bar body 458 with a pair of side arms 460 and 462 extending forwardly from opposite sides of the cross-bar body. A key block-out tab 464 extends forwardly from the bottom of cross-bar body 458. An upright tab 465 extends upwardly from the cross-bar body 458.

Tailpiece 116 is formed with a forward face 466 which is aligned to be seated on the rear face of body 458 of actuator 456. Also, opposite intermediate sides of forward face 466 are formed with protrusions 468 which extend along and taper into the sides of the tailpiece 116 for a short distance. A rear end 470 of tailpiece 116 is formed with inwardly tapered surfaces 472. Tailpiece anchor plate 118 is circular in shape and is formed centrally with a rectangular opening 474 through which the tapered end of tailpiece 116 is inserted. A pair of tapered grooves 476 are formed in opposite side walls of opening 474 to receive the tapered protrusions 468 along the sides of the body of tailpiece 116. This arrangement permits some free movement of tailpiece 116 relative to anchor plate 118 but facilitates retention of the tailpiece with the cylinder lock 44. A pair of spaced rounded slots 478 and 480 are formed in the periphery of anchor plate 118 and are spaced ninety degrees apart.

Cap 120 is formed with an axial opening 482 which is threaded. The periphery of cap 120 is knurled to facilitate gripping thereof. As viewed in FIG. 11, cap 120 is formed with a front face 484 having an axial opening 486 which communicates with threaded opening 482. The wall of opening 486 is formed with a plurality of slots 488 which combine to form a scalloped edge.

In assembly, plug 114 is positioned within opening 424 of shell 112 so that holes 420 of the plug are aligned with holes 426 of the shell. Tumbler pins 428, pusher pins 430 and springs 432 are inserted into holes 426 with the tumbler pins being located within holes 420 of plug 114. Cover 124 is then attached to the top of rib 122 to retain the pins 428 and 430, and the springs 432, as assembled. Springs 434, 450 and 454 are placed in respective holes 410, 416 and 414 with spring 434 being located in the counterbored portion 412.

Identifier pin 436 is positioned within hole 410 of plug 114 with shank 438 extending into the forward portion of hole 410 and shank 440 located within counterbored portion 412. Stop pin 442 is inserted into hole 416 of plug 114 with projection 446 extending toward cap 120. Stabilizer pin 452 is positioned within hole 414 of plug 114.

Identifier actuator 456 is positioned adjacent the rear face 408 of plug 114 so that arm 460 of the actuator is positioned in engagement with the rear face of pin 436. Tab 464 of actuator 456 is positioned within key slot 406 of plug 114 and tab 465 is located within slot 418 of the plug.

Tailpiece 116 is positioned so that forward face 466 is positioned against actuator 456. Anchor plate 118 is positioned over tailpiece 116 and cap 120 is threadedly positioned on threaded extension 409 of plug 114. As cap 120 is drawn toward a tight position, actuator 456 presses pins 436 and 452 into their respective holes 410 and 414 against the biasing compression of springs 434 and 454, respectively.

Pin 442 is positioned through slot 478 of anchor plate 118 with projection 446 being located in the vicinity of slots 488. In order to tighten cap 120 in place, pin 442 is depressed to allow the cap to be threadedly rotated on threaded extension 409 of plug 114. After cap 120 is located in a tightened position, the cap is positioned to permit projection 446 of pin 442 to extend into the adjacent most slot 488 on the cap. Since major portion 444 of pin 442 is too large to extend into any of the slots 488, the pin remains biased by spring 450 against the inner wall of the cap 120 adjacent the slots. In this position, projection 446 of pin 442 extends into one of the slots 488 of cap 120 to prevent any rotation of the cap. If adjustment of cap 120 is required, projection 446 is depressed against the biasing of spring 450 to clear the respective slot 488. Cap 120 is then rotated and projection 446 then locates in another slot 488 to lock the cap in the adjusted position. When turn button 36 is operated to lock assembly 20 from inside door 326, free floating tailpiece 116 is moved toward plug 114 thereby moving identifier actuator 456 further in the direction of the plug. With this movement, arm 460 moves identifier pin 436 further into hole 410 of plug 114 against the biasing action of spring 434. This causes the forward end of shank 438 to move out of hole 410 and extend a slight distance beyond front face 404 of plug 114. This provides an indication to someone on the outside of door 326 that lock assembly 20 is locked from inside the door. This is particularly useful in a hotel environment where hotel personnel may wish to enter the room for cleaning purposes, for example, but will recognize that door 326 is locked from the inside.

When pin 436 is pressed to cause the forward end of shank 438 to extend beyond front face 404 of plug 114, actuator 456 could become tilted if only arm 460 was performing the forward actuating action. To counter this possibility, arm 462 is formed on actuator 456 and extends forwardly in spaced relation with arm 460 the same distance as arm 460 extends from body 458. Arm 462 engages pin 452 which provides a balancing effect when depressing pin 436. Thus, as actuator 456 is moved, springs 434 and 454 provide a balancing influence upon the actuator so that pin 436 is moved axially within opening 410 of plug 114 while the actuator is maintained in an untilted orientation.

When actuator 456 is moved forward as noted above, tab 464 is moved into key slot 406. If an entry is attempted by inserting a key into slot 406 from front face 404, the key could not be inserted a sufficient distance to effect alignment of the tumbler pins 428 and push pins 430 for operation of lock 44. Therefore, tab 464 functions as a key block out which is selectively activated upon locking the lock assembly 20 by use of turn button 36 from inside door 326.

A special key for emergency use by hotel personnel can be made and includes a notched or cut-out section which allows the key to be fully inserted into key slot 406 and facilitates the opening of lock 44.

If the forward portion of shank 438 which extends beyond face 404 of plug 114 is bent, for example, by tampering, actuator 456 could remain in position with block-out tab 464 preventing operation of lock 44 by a conventional key. However, a notched hotel key would by-pass tab 464 and open the lock whereby spring 454 and pin 452 would urge actuator 456 rearwardly although pin 436 would not be retracted because of bent shank 438. A standard key can thereafter operate lock 44.

In an environment where privacy is desired such as, for example, a hotel room, a pushbutton is accessible to facilitate forward movement of actuator 456 and identifier pin 436. In a first option of pushbutton operation, the pushbutton is attached to the cap end of linkage bar 366 (FIG. 6) in place of turn button 36. Bar 366 is assembled in the manner previously described and extends through retractor 142. Referring to FIGS. 1 and 6, end 388 of linkage bar 366 is moved to a position to eventually engage the outboard end of tailpiece 116.

When the pushbutton is depressed, the free ends of the legs of a spring-biased U-shaped element within sleeve 168 are moved into a pair of spaced slots 500 and 502 (FIG. 6) formed on one edge of bar 366 to retain the bar in the depressed position. As bar 366 is being depressed, end 388 thereof engages and pushes tailpiece 116 toward plug 114 whereby tab 464 (FIG. 8) of actuator 456 is moved into key slot 406 to thereby block full entry of the key. In this manner, cylinder lock 44 cannot be operated by a regular key.

If the pushbutton is depressed while door 326 is open, when the door is closed and latchbolt 54 is momentarily depressed, a mechanism within sleeve 168 will remove the free ends of legs of the U-shaped element from slots 500 and 502 and linkage bar 366 will return to its unoperated position.

In another mode, a spanner key having bifurcated pins is inserted into the pushbutton whereafter the pushbutton can be depressed and then rotated. In this mode, the legs of the U-shaped element do not enter slots 500 and 502. However, upon rotation of the pushbutton, fingers 372 and 374 of bar 366 are moved behind a projection within sleeve 168 to retain the bar in the depressed and rotated position. Again, tailpiece 116 is moved to place tab 464 into key slot 406 and thereby block the key as before.

If this operation is effected while door 326 is open, bar 366 will remain in the depressed and rotated position when the door is closed. This permits hotel personnel to lock the door to prevent entry with an ordinary key. The notched hotel security key can be used by authorized personnel to bypass the blocking effect of tab 464 and unlock cylinder lock 44 to permit opening of door 326.

A catch plate is located within sleeve 170 (FIG. 1) and is spring biased to extend partially through slot 330 (FIG. 3). When lever 46 is placed over sleeve 170, the catch plate will be biased into a depression formed on the inner wall of lever opening 132. A small hole extends through hub 128 of lever 46 and communicates with the depression to facilitate depression of the catch plate when it is desired to remove the lever.

When a lever operator, such as lever 46, is used, key slot 406 and rib 122 of lock 44 are aligned horizontally. Also, tailpiece 116 is aligned horizontally. In this position, tailpiece 116 prevents depression of the catch plate within sleeve 170 so that lever 46 cannot be removed. When the key is used to operate lock 44 and turn tailpiece 116, the catch plate can now be depressed and lever 46 can be removed.

When a user desires to change from the lever system to a knob system, key slot 406 is arranged vertically which results in tailpiece 116 being arranged vertically. Since the tailpiece 116 must be in the horizontal orientation to prevent the catch plate from being depressed, the change to the knob system with a tailpiece of fixed orientation will not permit the use of the same cylinder lock for both lever and knob systems. In the past, separate cylinder locks were made for the lever and knob systems and were not interchangeable.

With cylinder lock 44, when switching from a lever system to a knob system, cap 120 can be removed along with anchor plate 118 and tailpiece 116. Plate 118 and tailpiece 116 are then turned ninety degrees from the previous orientation of alignment with key slot 406 and rib 122 so that face 466 of the tailpiece is aligned with crossbar body 458 of actuator 456. Tailpiece 116, anchor plate 118 and cap 120 are reassembled with plug 114 in the manner previously described with stop pin 442 being positioned in slot 480 of the plate and one of the slots 488 to lock the cap in the tightened position.

Thus, the same cylinder lock 44 can be used with a lever or a knob whereby the orientation of tailpiece 116 can be adjusted to insure that the catch plate cannot be depressed without key operation of the lock regardless of whether a lever system or a knob system is used.

In general, the above-described embodiment is not to be construed as limiting the breadth of the present invention. Modifications, and other alternative constructions, will be apparent which are within the spirit and scope of the invention as defined in the appended claims.

What is claimed is:

1. A cylinder lock, which comprises:

a shell having an axial opening;

a plug assembled within the axial opening of the shell;

a rib extending radially from the shell along the length thereof and having a plurality of transaxis holes formed therethrough in communication with the axial opening;

a corresponding plurality of transaxis holes formed in the plug in alignment with the plurality of holes of the rib;

a key slot formed in a first or entry end of the plug in the axial direction and extending to a second end thereof n communication with the plurality of holes thereof;

a corresponding plurality of tumbler pins located and retained within the holes of the plug;

a tailpiece;

a first pin mounted biasingly in a first hole in the plug from the second end thereof and extendable through the first hole at the first end of the plug;

a second pin mounted biasingly in a second hole in the second end of the plug in spaced relation to the first pin, and means, movable upon movement of the tailpiece toward the plug and independently of the first pin and the second pin, for moving the first pin and second pin into the plug.

2. A cylinder lock, which comprises:

a shell having an axial opening;

a plug assembled within the axial opening of the shell;

a rib extending radially from the shell along the length thereof and having a plurality of transaxis holes formed therethrough in communication with the axial opening;

a corresponding plurality of transaxis holes formed in the plug in alignment with the plurality of holes of the rib;

a key slot formed in a first or entry end of the plug in the axial direction and extending to a second end thereof in communication with the plurality of holes thereof;

a corresponding plurality of tumbler pins located and retained within the holes of the plug;

a tailpiece;

an actuator which is unattached and free floating within the cylinder lock;

at least one spring which maintains the actuator in biased arrangement between the lug and the tailpiece;

a tab formed with the actuator which is aligned with the key slot and movable therein upon movement of the tailpiece toward the plug; and means for selectively moving the tabs into the key slot in response to movement of the tailpiece toward the plug.

3. A cylinder lock, which comprises:

a shell having an axial opening;

a plug assembled within the axial opening of the shell;

a rib extending radially from the shell along the length thereof and having a plurality of transaxis holes formed therethrough in communication with the axial opening;

a corresponding plurality of transaxis holes formed in the plug in alignment with the plurality of holes of the rib;

a key slot formed in a first or entry end of the plug in the axial direction and extending to a second end thereof in communication with the plurality of holes thereof;

a corresponding plurality of tumbler pins located and retained within the holes of the plug;

a tailpiece;

adjusting means for adjustably attaching the tailpiece to the second end of the plug so that the tailpiece can e adjustably positioned in at least two orientations relative to the orientation of the key slot;

a first pin mounted biasingly in a first hole in the plug from the second end of the plug and extendible through the first hole at the first end of the plug;

a second pin mounted biasingly in a second hole in the second end of the plug in a spaced relation to the first pin;

means, movable upon movement of the tailpiece toward the plug and independently of the first pin and the second pin, for moving the first pin and the second pin into the plug;

means for blocking the key slot from the second end of the plug, and means for selectively moving the blocking means into the key slot in response to movement of the tailpiece toward the plug.

* * * * *